United States Patent [19]

Stanley

[11] 4,387,982

[45] Jun. 14, 1983

[54] CHARGED PARTICLE CONTAINMENT APPARATUS

[75] Inventor: Michael R. Stanley, Pittsford, N.Y.

[73] Assignee: Xerox Corporation, Stamford, Conn.

[21] Appl. No.: 279,415

[22] Filed: Jul. 1, 1981

[51] Int. Cl.[3] ..... G03G 15/08

[52] U.S. Cl. ..... 355/3 DD; 118/653; 118/656

[58] Field of Search ..... 355/3 R, 3 DD; 118/653, 118/656, 657, 658, 661

[56] References Cited

U.S. PATENT DOCUMENTS

| | | | |
|---|---|---|---|
| 3,412,710 | 11/1968 | Robinson | 118/637 |
| 3,682,538 | 8/1972 | Cade et al. | 355/3 DD |
| 3,906,899 | 9/1975 | Harpavat | 118/657 X |
| 3,918,402 | 11/1975 | Ohta | 118/656 X |
| 3,926,516 | 12/1975 | Whited | 355/3 DD |
| 3,991,713 | 11/1976 | Whited | 118/637 |

FOREIGN PATENT DOCUMENTS

| | | | |
|---|---|---|---|
| 55-41449 | 3/1980 | Japan | 355/3 DD |

*Primary Examiner*—Fred L. Braun

*Attorney, Agent, or Firm*—H. Fleischer; J. E. Beck; R. Zibelli

[57] ABSTRACT

An apparatus which reduces the scattering of charged particles from a housing storing a supply thereof in a reproducing machine having photoconductive member with an image voltage level recorded on a portion thereof. A particle holder is electrically biased to a voltage level different than that of the image voltage recorded on the photoconductive member. In this way, an electrical field is formed between the photoconductive member and the particle holder which repels or attracts the charged particles therefrom. The particle holder is readily removable from the reproducing machine so as to facilitate the periodic cleaning of charged particles therefrom.

26 Claims, 3 Drawing Figures

Issued: Nov. 16, 1976

CHARGED PARTICLE CONTAINMENT APPARATUS

This invention relates generally to an electrophotographic printing machine, and more particularly concerns an apparatus for reducing the scattering of charged particles from a housing storing a supply thereof.

Generally, in the process of electrophotographic printing a photoconductive member is charged to a substantially uniform potential to sensitize the surface thereof. The charged portion of the photoconductive surface is exposed to a light image of an original document being reproduced. This records an electrostatic latent image on the photoconductive member which corresponds to the informational areas contained within the original document. After recording the electrostatic latent image on the photoconductive member, the latent image is developed by bringing developer material into contact therewith. Generally, the developer material comprises toner particles adhering triboelectrically to carrier granules. The toner particles are attracted from the carrier granules to form a powder image on the photoconductive member which is subsequently transferred to a copy sheet. Finally, the copy sheet is heated to permanently affix the powder image thereto in image configuration.

One of the problems in electrophotographic printing is the contamination of various processing stations by the charged toner particles. Frequently, the charged toner particles escape from the developer housing to float throughout the printing machine. These charged particles are attached to critical surfaces of the processing stations resulting in contamination and degradation of the performance of that subsystem. It is essential that many elements of the printing machine remain substantially free from contaminating particles. For example, any particles contaminating the optics may directly result in deterioration of the resulting image and the production of an inferior copy therefrom.

Generally, the development system has seals between the developer housing and photoconductive member to prevent leakage of toner particles therefrom. In addition or alternately thereto, the developer housing may be maintained at a negative pressure to insure that airflow is in an inwardly direction rather than in an outwardly direction from the chamber storing the carrier granules and toner particles. However, it has been found that even with the foregoing provisions, toner particles escape from the developer housing contaminating various components of the printing machine. The following disclosures appear to be relevant:

U.S. Pat. No. 3,412,710
Patentee: Robinson
Issued: Nov. 26, 1968

U.S. Pat. No. 3,682,538
Patentee: Cade et al.
Issued: Aug. 8, 1972

U.S. Pat. No. 3,926,516
Patentee: Whited
Issued: Dec. 16, 1975

U.S. Pat. No. 3,991,713
Patentee: Whited

The pertinent portions of the foregoing disclosures may be briefly summarized as follows:

Cade et al. discloses a cascade development system having a pickoff plate disposed below the biased electrode in the developer housing.

Robinson describes a cascade development system having a clean up electrode disposed below the biased electrode in the developer housing.

Both of the Whited patents disclose a magnetic brush development system having conductive plates secured to and extending outwardly from the developer housing. The conductive plates are substantially parallel to and closely spaced from the photoconductive surface. An insulating material is interposed between the plate and developer housing. The plates are electrically biased to a potential somewhat greater than the background voltage of the latent image.

In accordance with one aspect of the features of the present invention, there is provided an apparatus for reducing the scattering of charged particles from a housing storing a supply thereof in a reproducing machine comprising a member having a voltage level formed on at least a portion thereof. The apparatus includes means for holding scattered charged particles. Means electrically bias the holding means to a voltage level having a magnitude less than the magnitude of the voltage level of the member. In this way, an electrical field is formed between the holding means and the portion of the member having the voltage level formed thereon which repels charged particles of one polarity from the holding means. An electrical field is also formed between the other portions of the member having a voltage level thereon less than the voltage level of the holding means and the holding means which attracts the charged particles to the holding means.

Pursuant to another aspect of the features of the present invention, there is provided an apparatus for developing an image voltage region recorded on a photoconductive member having a non-image voltage region and an image voltage region thereon. The apparatus includes means for depositing charged particles onto the image voltage region to form a particle image. Means are provided for holding charged particles scattered from the depositing means. Means electrically bias the holding means to a voltage level having a magnitude intermediate the magnitude of the image voltage level and the magnitude of the non-image voltage level. In this way, an electrical field is formed between the image voltage region and the holding means which repels charged particles of one polarity from the holding means to the image voltage region of the photoconductive member. An electrical field is also formed between the non-image voltage region and the particle holder which attracts the charged particles to the holding means.

Still another aspect of the present invention is an electrophotographic printing machine of the type having a photoconductive member, a corona generating device adapted to charge at least a portion of the photoconductive member to a substantially uniform level, and an imaging system arranged to focus a light image at an original document onto the charged portion of the photoconductive member to record an image voltage region and a non-image voltage region thereon. Means deposit charged toner particles onto the image voltage region to form a toner powder image on the photoconductive member. Means are provided for holding charged toner particles scattered from the depositing means. Means electrically bias the holding means to a voltage level having a magnitude intermediate the magnitude of the image voltage level and the magnitude of the non-image voltage level. In this way, an electrical field is formed between the holding means and the image voltage region which repels the charged toner particles of one polarity from the holding means to the image voltage region. An electrical field is also formed between the holding means and the non-image voltage region which attracts the charged toner particles to the holding means.

In accordance with still another aspect of the features of the present invention, there is provided an apparatus for reducing the scattering of charged particles from a housing storing a supply thereof in a reproducing machine comprising a member having a voltage level formed on at least a portion thereof. The apparatus includes means for holding scattered charged particles. Means electrically bias the holding means to a voltage level having a magnitude greater than the magnitude of the voltage level of the member. In this way, an electrical field is formed between the holding means and the member which attracts charged particles of one polarity to the holding means.

Pursuant to still another aspect of the features of the present invention, there is provided an apparatus for developing an image voltage region recorded on a photoconductive member. The apparatus includes means for depositing charged particles onto the image voltage region to form a particle image. Means are provided for holding charged particles scattered from the depositing means. Means electrically bias the holding means to a voltage level having a magnitude greater than the magnitude of the image voltage level. In this way, an electrical field is formed between the image voltage region and the holding means which attracts charged particles of one polarity to the holding means.

Finally, still another aspect of the present invention is an electrophotographic printing machine of the type having a photoconductive member, a corona generating device adapted to charge at least a portion of the photoconductive member to a substantially uniform level, and an imaging system arranged to focus a light image at an original document onto the charged portion of the photoconductive member to record an image voltage region thereon. Means deposit charged toner particles onto the image voltage region to form a toner powder image on the photoconductive member. Means are provided for holding charged toner particles scattered from the depositing means. Means electrically bias the holding means to a voltage level having a magnitude greater than the magnitude of the image voltage level. In this way, an electrical field is formed between the holding means and the photoconductive member which attracts charged toner particles of one polarity to the holding means.

Other aspects of the present invention will become apparant as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
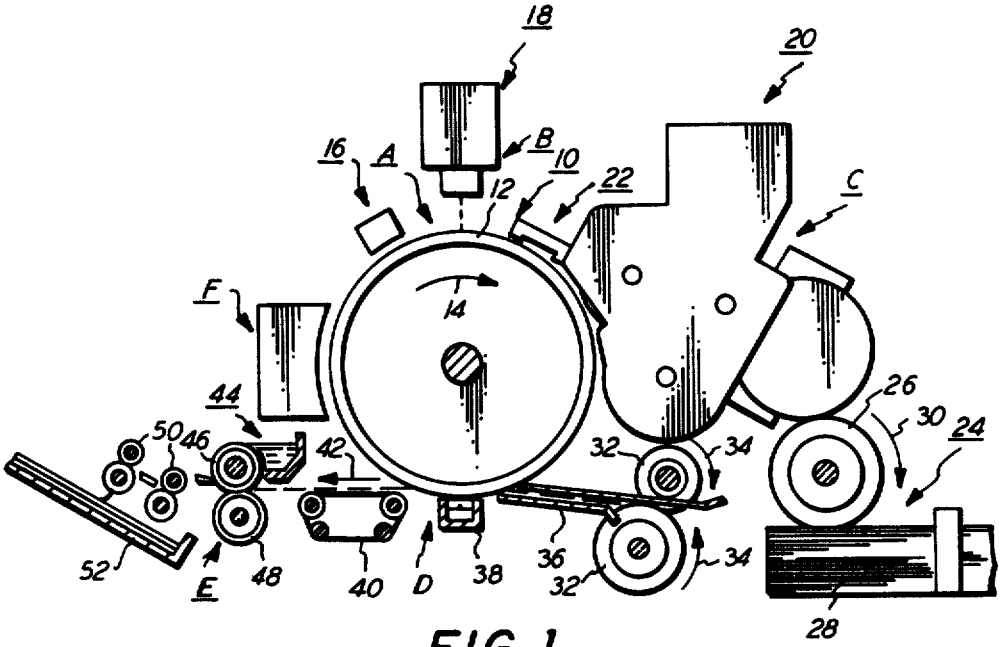
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the apparatus of the present invention therein. It will become evident from the following discussion that this apparatus is equally well suited for use in a wide variety of electrostatographic printing machines, and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12. Preferably, photoconductive surface 12 comprises a selenium alloy deposited on a conductive substrate such as an aluminum alloy. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high substantially uniform potential.

Next, the charged portion of photoconductive surface 12 is advanced through imaging station B. Imaging station B includes an exposure system indicated generally by the reference numeral 18. In exposure system 18, an original document is positioned faced down upon a transparent platen. Light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. Thereafter, drum 10 advances the electrostatic latent image recorded on photoconductive surface 12 to development station C.

Figure 2:
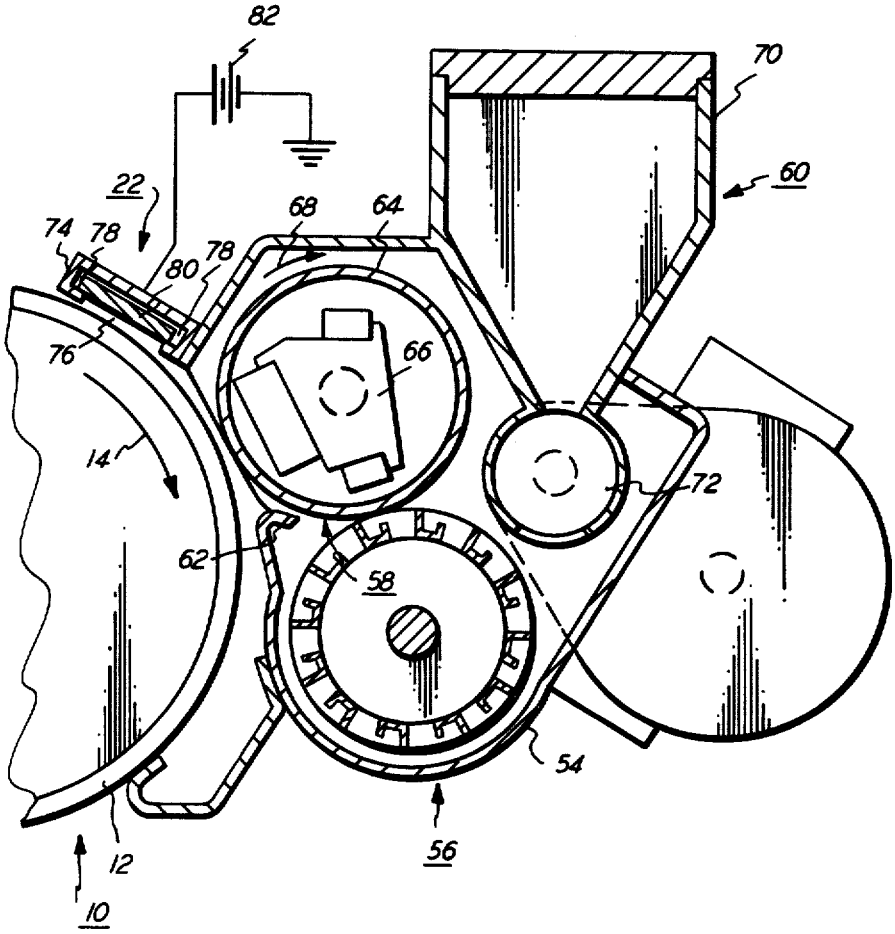
FIG. 2 is an elevational view depicting the development system of the FIG. 1 printing machine.

At development station C, a magnetic brush development system, indicated generally by the reference numeral 20, transports a developer mixture of carrier granules having toner particles adhering triboelectrically thereto into contact with the electrostatic latent image. The latent image attracts the charged toner particles forming a powder image on photoconductive surface 12 of drum 10. Charged toner particles are prevented from scattering or escaping from the housing of development system 20 by a containment apparatus, indicated generally by the reference numeral 22. Preferably, containment apparatus 22 is interposed between exposure system 18 and development system 20. In this way, containment apparatus 22 prevents the scattering of charged toner particles onto the various subsystems within the printing machine, and, more particularly, prevents the depositing of charged toner particles onto exposure system 18 and corona generating device 16. The detailed structure of development system 20 and containment apparatus 22 will be described hereinafter with reference to FIGS. 2 and 3.

Drum 10 then advances the powder image to transfer station D. At transfer station D, a sheet of support material is moved into contact with the powder image. The sheet of support material is advanced to transfer station D by a sheet feeding apparatus, indicated generally by the reference numeral 24. Preferably, sheet feeding apparatus 24 includes a feed roll 26 contacting the uppermost sheet of a stack of sheets 28. Feed roll 26 rotates in the direction of arrow 30 so as to advance the uppermost sheet into the nip defined by forwarding rollers 32. Forwarding rollers 32 rotate in the direction of arrow 34 to advance the sheet into chute 36. Chute 36 directs the advancing sheet of support material into contact with photoconductive surface 12 of drum 10 so that the powder image developed thereon contacts the advancing sheet at transfer station D.

Preferably, transfer station D includes a corona generating device 38 which sprays ions onto the backside of the sheet. This attracts the powder image from photoconductive surface 12 to the sheet. After transfer, the sheet continues to move in the direction of arrow 42 onto a conveyor 40 which advances the sheet to fusing station E.

Fusing station E includes a fuser assembly, indicated generally by the reference numeral 44, which permanently affixes the transferred powder image to the sheet. Preferably, fuser assembly 44 includes a heated fuser roller 46 and a back-up roller 48. The sheet passes between fuser roller 46 and back-up roller 48 with the powder image contacting fuser roller 46. In this manner, the powder image is permanently affixed to the sheet. After fusing, forwarding rollers 50 advance the sheet to catch tray 52 for subsequent removal from the printing machine by the operator.

It is believed that the foregoing description is sufficient for purposes of the present application to illustrate the general operation of an electrophotographic printing machine incorporating the features of the present invention therein.

Referring now to the specific subject matter of the present invention, the primary components of development system 20 are developer housing 54, paddle wheel 56, developer roller 58, and toner dispenser 60. Paddle wheel 56 is a cylindrical member with buckets or scoops around the periphery thereof. As paddle wheel 56 rotates, the developer material is elevated from the lower region of the chamber of housing 54 to developer roller 58. The magnetic field produced by the fixed magnets in developer roller 58 attract the developer material from paddle wheel 56 thereto. Developer roller 58 transports the developer material into contact with the electrostatic latent image recorded on photoconductive surface 12 of drum 10. A surplus of developer material is furnished and metering blade 62 controls the amount of developer material transported into contact with the electrostatic latent image. Preferably, developer roller 58 includes a non-magnetic tubular member 64 having an irregular or roughened exterior surface. Tubular member 64 is journaled for rotation by suitable means such as ball bearing mounts. A shaft assembly is concentrically mounted within tubular member 64 and serves as a fixed mounting for magnetic member 66. The shaft assembly also can act as part of the magnetic circuit. Tubular member 64 rotates in the direction of arrow 68. Toner dispenser 60 includes a container 70 storing a supply of toner particles therein. A foam roller 72 is positioned in the aperture of container 70. As roller 72 rotates, toner particles are dispensed from container 70 into the chamber of housing 54. These toner particles mix with the carrier granules to form the developer material which is subsequently advanced by paddle wheel 56 to developer roller 58.

Containment apparatus 22 includes a frame 74 secured to housing 54. Frame 74 has an open ended portion 76 and opposed grooves 78. Plate 80 is mounted slidably in grooves 78. In this way, plate 80 may be readily removed from frame 74 to facilitate the cleaning of toner particles collected thereon by the machine operator. Voltage source 82 is electrically connected to frame 74 so as to electrically bias plate 80. Both plate 80 and frame 74 are made from an electrically conductive material such as any suitable metal. Similarly, housing 54 is also made from an electrically conductive metal. In this way, voltage source 82 electrically biases both plate 80 and housing 54 to substantially the same potential. Alternatively, frame 74 may be electrically spaced or insulated from housing 54. In this way, plate 80 may be electrically biased to one potential with housing 54 being electrically biased to another potential. Preferably, plate 80 is spaced a distance ranging from about 0.030 inches to about 0.100 inches from photoconductive surface 12. Voltage source 82 electrically biases plate 80 to a potential intermediate the background and image voltage recorded on photoconductive surface 12. For example, if the image areas recorded on photoconductive surface 12 have a potential of about +850 volts and the background areas thereon a potential of about +150 volts, voltage source 82 electrically biases plate 80 to about +350 volts. However, the electrical bias of plate 80 may range from about +250 volts to about +750 volts. The toner particles normally have a negative charge. Thus, the electrical field formed between plate 80 and photoconductive surface 12, in the background areas, attracts the toner particles to plate 80. However, the electrical field formed between plate 80 and photoconductive surface 12, in the image areas, repels the toner particles away from plate 80 toward photoconductive surface 12. Alternatively, if the image areas and background areas are normally at a negative voltage level, positive toner particles are normally employed. The resultant electrical field between photoconductive surface 12 and plate 80 will either repel or attract these toner particles. With regard to the wrong sign or incorrectly charged toner particles, i.e. positive toner particles in a normally negative toner particle system or negative toner particles in a normally positive toner particle system, these particles will be attracted or repelled in the opposite manner to the toner particles having the correct polarity. In this way, the scattered toner particles are either attracted to and held on plate 80 or repelled therefrom to the image areas of photoconductive surface 12. After the elapse of a suitable period of time, plate 80 is removed from frame 74 and wiped clean by the machine operator to remove the toner particles collected thereon. Preferably, frame 74 is mounted on the upper portion of housing 54 so as to be interposed between exposure system 18 and development system 20. Inasmuch as plate 80 is positioned closely adjacent to photoconductive surface 12, plate 80 increases the impedance to air flowing from housing 54. This reduces the exit rate of toner particles being scattered from housing 54 in this region.

One skilled in the art will appreciate that while plate 80 has been described as being electrically biased to a voltage level intermediate that of the background voltage level and image voltage level, it may be electrically biased to a voltage level greater than the image voltage level or less than the background voltage level. If the voltage level of plate 80 is greater than the image voltage level, the toner particles of the correct polarity are attracted to plate 80 with those of the wrong polarity being repelled therefrom. However, if the voltage level of plate 80 is less than the background voltage level, the opposite will occur.

Figure 3:
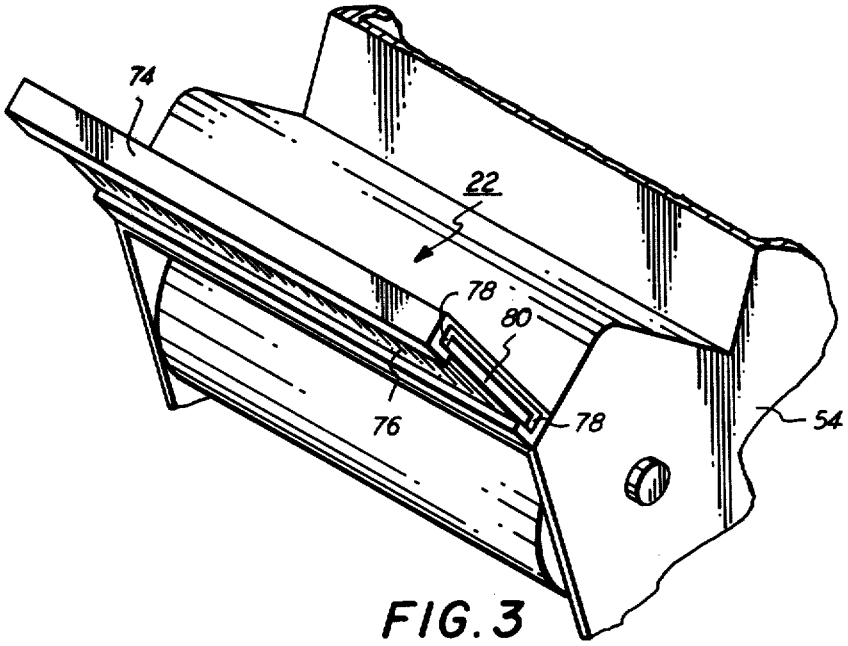
FIG. 3 is a fragmentary perspective view showing the plate of the FIG. 2 development system for attracting and repelling charged toner particles scattered therefrom.

Turning now to FIG. 3, there is shown a fragmentary perspective view illustrating containment apparatus 22. As depicted thereat, frame 74 is mounted on housing 54 by suitable means such as screws. Frame 74 extends across housing 54 so as to enable plate 80 to attract or repel any toner particles being scattered outwardly from developer housing 54. Plae 80 is mounted in grooves 78 of frame 74. Frame 74 has an open end 76 positioned opposed from photoconductive surface 12 from drum 10. In this way, plate 80 is positioned closely adjacent to photoconductive surface 12 so as to attract or repel the charged toner particles scattered from housing 54.

In recapitulation, it is evident that the apparatus of the present invention utilizes an electrically biased plate to attract thereto charged toner particles scattered from the developer housing, and to repel the scattered toner particles to the image regions of the photoconductive surface. The plate is readily removable from the printing machine to facilitate operator cleaning thereof. In this way, contamination of the various subsystems within the printing machine is reduced.

It is, therefore, evident that there has been provided in accordance with the present invention an apparatus for containing toner particles being scattered from a developer housing of an electrophotographic printing machine. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing an image voltage region recorded on a photoconductive member having a non-image voltage region and an image voltage region thereon, including:

a housing defining a chamber for storing charged particles therein;

means, positioned interiorly of the chamber of said housing, for transporting the charged particles from the chamber of said housing to the photoconductive member so as to deposit charged particles onto the image voltage region to form a particle image;

means, positioned exteriorly of the chamber of said housing, for holding charged particles scattered from the chamber of said housing; and means for electrically biasing said holding means to a voltage level having a magnitude intermediate the magnitude of the image voltage level and the magnitude of the non-image voltage level so as to form an electrical field between the non-image voltage region and said holding means which attracts charged particles of one polarity to said holding means and an electrical field between the image voltage region and said holding means which repels the charged particles from said holding means to the image voltage region of the photoconductive member.

2. An apparatus according to claim 1, wherein said holding means is positioned closely adjacent to the photoconductive member.

3. An apparatus according to claim 2, wherein the photoconductive member moves relative to said holding means, said holding means being positioned so as to increase the impedance of air flowing from the chamber of said housing to reduce the escape rate of the charged particles therefrom.

4. An apparatus according to claim 3, wherein said holding means includes:

a frame mounted on said housing; and a plate mounted slidably in said frame, said plate being readily removable from said frame so as to clean therefrom charged particles adhering thereto.

5. An apparatus according to claim 4, wherein:

said frame is made from an electrically conductive material; and said plate is made from an electrically conductive material.

6. An apparatus according to claim 4, wherein said biasing means electrically biases said housing to substantially the same potential as said plate.

7. An electrophotographic printing machine of the type having a photoconductive member, a corona generating device adapted to charge at least a portion of the photoconductive member to a substantially uniform level, and an imaging system arranged to focus a light image of an original document onto the charged portion of the photoconductive member to record an image voltage region and a non-image voltage region thereon, wherein the improvement includes:

a housing defining a chamber for storing a developer mixture comprising carrier granules having charged toner particles adhering triboelectrically thereto;

means, positioned interiorly of the chamber of said housing, for transporting the developer mixture from the chamber of said housing to the image voltage region so that the toner particles are attracted thereto to form a toner powder image on the photoconductive member;

means, positioned exteriorly of the chamber of said housing, for holding charged toner particles scattered from the chamber of said housing; and means for electrically biasing said holding means to a voltage level having a magnitude intermediate the magnitude of the image voltage level and the magnitude of the non-image voltage level so as to form an electrical field between the non-image voltage region and said holding means which attracts charged toner particles of one polarity to said holding means and an electrical field between the image voltage region and said holding means which repels the charged toner particles from said holding means to the image voltage region of the photoconductive member.

8. A printing machine according to claim 7 wherein said holding means is positioned closely adjacent to the photoconductive member.

9. A printing machine according to claim 8, wherein the photoconductive member moves relative to said holding means, said holding means being positioned so as to increase the impedance of air flowing from the chamber of said housing to reduce the escape rate of the charged toner particles therefrom.

10. A printing machine according to claim 9, wherein said holding means is interposed between the imaging system and said transporting means.

11. A printing machine according to claim 10, wherein said holding means includes:

a frame mounted on said housing; and a plate mounted slidably in said frame, said plate being readily removable from the frame so as to clean therefrom charged toner particles adhering thereto.

12. A printing machine according to claim 11, wherein:

said frame is made from an electrically conductive material; and said plate is made from an electrically conductive material.

13. A printing machine according to claim 11, wherein said biasing means electrically biases said housing to substantially the same potential as said plate.

14. An apparatus for developing an image voltage region recorded on a photoconductive member, including:

a housing defining a chamber for storing charged particles therein;

means, positioned interiorly of said housing, for transporting the charged particles from the chamber of said housing to the image voltage region of the photoconductive member to deposit the charged particles onto the image voltage region to form a particle image;

means, positioned exteriorly of said housing, for holding charged particles scattered from the chamber of said housing; and means for electrically biasing said holding means to a voltage level having a magnitude greater than the magnitude of the image voltage level so as to form an electrical field between the image voltage region and said holding means which attracts charged particles of one polarity to said holding means.

15. An apparatus according to claim 14 wherein said holding means is positioned closely adjacent to the photoconductive member.

16. An apparatus according to claim 15, wherein the photoconductive member moves relative to said holding means, said holding means being positioned so as to increase the impedance of air flowing from the chamber of said housing to reduce the escape rate of the charged particles therefrom.

17. An apparatus according to claim 16, wherein said holding means includes:

a frame mounted on said housing; and a plate mounted slidably in said frame, said plate being readily removable from said frame so as to clean therefrom charged particles adhering thereto.

18. An apparatus according to claim 17, wherein:

said frame is made from an electrically conductive material; and said plate is made from an electrically conductive material.

19. An apparatus according to claim 17, wherein said biasing means electrically biases said housing to substantially the same potential as said plate.

20. An electrophotographic printing machine of the type having a photoconductive member, a corona generating device adapted to charge at least a portion of the photoconductive member to a substantially uniform level, and an imaging system arranged to focus a light image of an original document onto the charged portion of the photoconductive member to record an image voltage region thereon, wherein the improvement includes:

a housing defining a chamber for storing a developer mixture comprising carrier granules having charged toner particles adhering triboelectrically thereto;

means, positioned interiorly of said housing, for transporting the developer mixture from the chamber of said housing to the image voltage region so that the toner particles are attached thereto to form a toner powder image on the photoconductive member;

means, positioned exteriorly of said housing, for holding charged toner particles scattered from the chamber of said housing; and means for electrically biasing said holding means to a voltage level having a magnitude greater than the magnitude of the image voltage level so as to form an electrical field between the photoconductive member and said holding means which attracts charged toner particles of one polarity to said holding means.

21. A printing machine according to claim 20, wherein said holding means is positioned closely adjacent to the photoconductive member.

22. A printing machine according to claim 21, wherein the photoconductive member moves relative to said holding means, said holding means being positioned so as to increase the impedance of air flowing from the chamber of said housing to reduce the escape rate of the charged toner particles therefrom.

23. A printing machine according to claim 22, wherein said holding means is interposed between the imaging system and said transporting means.

24. A printing machine according to claim 23, wherein said holding means includes:

a frame mounted on said housing; and a plate mounted slidably in said frame, said plate being readily removable from the frame so as to clean therefrom charged toner particles adhering thereto.

25. A printing machine according to claim 24, wherein:

said frame is made from an electrically conductive material; and said plate is made from an electrically conductive material.

26. A printing machine according to claim 24, wherein said biasing means electrically biases said housing to substantially the same potential as said plate.

* * * * *